US005333001A

United States Patent [19]

Profera, Jr.

[11] Patent Number: 5,333,001

[45] Date of Patent: Jul. 26, 1994

[54] MULTIFREQUENCY ANTENNA ARRAY

[75] Inventor: Charles E. Profera, Jr., Cherry Hill, N.J.

[73] Assignee: Martin Marietta Corporation, East Windsor, N.J.

[21] Appl. No.: 62,832

[22] Filed: May 18, 1993

[51] Int. Cl.[5] ..... H01Q 3/22; H01Q 3/24; H01Q 3/26

[52] U.S. Cl. ..... 342/373; 342/368; 342/372

[58] Field of Search ..... 342/368, 372, 373

[56] References Cited

U.S. PATENT DOCUMENTS

| | | | |
|---|---|---|---|
| 4,899,160 | 2/1990 | Kuwahara | 342/372 |
| 4,980,691 | 12/1990 | Rigg et al. | 342/372 |
| 4,994,814 | 2/1991 | Aoki et al. | 342/372 |
| 5,017,927 | 5/1991 | Agrawal et al. | 342/371 |
| 5,025,485 | 6/1991 | Csongor et al. | 455/12 |
| 5,128,683 | 7/1992 | Freedman et al. | 342/158 |

*Primary Examiner*—Theodore M. Blum
*Attorney, Agent, or Firm*—W. H. Meise; C. A. Berard; S. A. Young

[57] ABSTRACT

According to the invention, a two-dimensional active antenna array, operating at a number of different frequencies, is used to achieve directivity in two orthogonal planes, thereby providing a more constrained beam "footprint". The array includes a larger number of amplifiers than a line array, thereby increasing the total power which can be combined in space, to further increase the power in the footprint. For transmission, each of the information channels at a different frequency is applied, as in the prior art, to a different power divider array, each of which may be on a separate board. Power-divided signal from each of the information signal channels is applied to an N-input, M-output power combiner arrangement or board, which combines the signals. Each N×M power combiner arrangement includes N×M nodes. Each node represents the junction or crossing of one input and one output signal transmission path. At each node, a power sample is extracted from the input signal, phase shifted, and coupled onto the output line. Each of the M output transmission lines therefore receives N phase-shifted samples of the input signals at their different frequencies, which combine to produce the desired output signal for application to the antennas of the array. In a particular embodiment of the invention, directional couplers provide the input signal sampling and the recombining. In another embodiment, resistance taps provide the sampling.

13 Claims, 6 Drawing Sheets

MULTIFREQUENCY ANTENNA ARRAY

BACKGROUND OF THE INVENTION

This invention relates to multifrequency antenna arrays, including active antenna arrays, which are useful in frequency-multiplexed multichannel communications systems.

Present-day communication satellites or spacecraft provide multichannel communication links between ground stations, often using reflector antennas with multiple feeds. Because of the weight and reliability limitations of spacecraft and performance limitations of the antennas, attention has been directed toward substitution of active array antennas for the reflector/feed systems now used. Active array antennas are well known for other uses, as described, for example, in U.S. Pat. No. 5,128,683, issued Jul. 7, 1992 in the name of Freedman et al, in which the use is air traffic control radar. A monopulse antenna array system is described in U.S. Pat. No. 5,017,927, issued May 21, 1991 in the name of Agrawal et al, which includes an active array antenna with cascaded beamformers for sum, elevation difference (Δ) and azimuth Δ signals. A multichannel spacecraft communication system is described in U.S. Pat. No. 5,025,485, issued Jun. 18, 1991 in the name of Csongor et al, in which plural information channels are distributed to the antennas on different phases of a common carrier frequency.

FIG. 1 is a simplified block diagram of a prior art spacecraft 10 with a communication system. The communication system includes a reflector-type uplink antenna 12 which receives a plurality of channels, which may be in non-overlapping frequency bands. The received signals are amplified in a low-noise amplifier (LNA) arrangement 14, and block converted to a lower frequency in a down-converter 16. The downconverted signals are demultiplexed in a demultiplexer 18, to separate the signals into separate channels at different carrier frequencies, which are applied to input ports 28*a*, 28*b*, 28*c*, . . . 28*h* of an antenna beamformer 30. Beamformer 30 combines the channelized signals at different frequencies applied to its input ports 28*c*–28*h* (where the hyphen represents the word "through"), to produce a plurality of output signals, one of which is on each of output ports 48(*a*) , 48(2) , 48(3) , . . . 48(8). The signal produced at each output port 48 of beamformer 30 of FIG. 1 includes a component at each of the different frequencies appearing at the input ports 28 of beamformer 30. The signals from output ports 48(1), 48(2), 48(3), . . . 48(8) of beamformer 30 are applied to antennas 51*a*, 51*b*, 51*c*, . . . 51*h*, respectively, of an antenna array 100. Antennas 51 as illustrated in FIG. 1 are arranged as a vertical line array, and each antenna is elongated horizontally, or includes a plurality of radiators extending orthogonal to both the array direction and the direction of radiation 49, to thereby form two-dimensional transmit array 100.

FIG. 2*a* is a simplified, conceptual diagram, in perspective or isometric view, of a prior-art beamformer, which may be used for transmission (or reception, if an array receiving antenna is used) in the arrangement of FIG. 1. For definiteness, the beamforming network of FIG. 2*a* represents transmit beamforming network 30 of FIG. 1. Elements of FIG. 2*a* corresponding to those of FIG. 1 are designated by like reference numerals. In FIG. 2*a*, eight input signal ports 28*a*, 28*b*, and 28*c*–28*h* are embodied as coaxial connectors. Each of connector ports 28*a*–28*h* receives an information channel at a different frequency, downconverted from the uplink signals received by antenna 12 of FIG. 1. The purpose of beamformer 30 is to redistribute the eight information channels among the eight antennas 51*a*, 51*b*, 51*c*, . . . 51*h* of array antenna 100, with phase selected to produce the desired beam, and amplified to compensate for system and path losses to thereby provide a predetermined signal strength at all receiving locations within the footprint. As illustrated in FIG. 2*a*, each input port connector 28*a*–28*h* is coupled to a corresponding power divider (PD) board 42*a*–42*h*. Each power divider board 42 divides its input signal into eight equal portions, which are made available on output signal paths 44. Each output signal path of a power divider board 42 is a coaxial signal path, designated by the same letter as the letter designation of the power divider board, together with a further numerical designation, ranging from 1 to 8, identifying its position, starting from the top of the structure. Thus, the uppermost output signal path originating from PD board 42*a* is designated 44*a*1. Other uppermost signal paths include path 44*b*1, originating from PD board 42*b*, and 44*c*1, originating from PD board 42*c*, etc. The uppermost signal path originating from PD board 44*h* is designated 44*h*1, the next lower one is 44*h*2. In the third layer, the output signal path from PD board 42*h* is 44*h*3. The lowermost output signal path from PD board 42*h* is 44*h*8.

The uppermost layer of signal paths 44 in FIG. 2*a* is coupled to an uppermost signal combining (SC) board 46(1), which combines the information signals received at different frequencies from signal paths 44*a*1, 44*b*1, 44*c*1 . . . 44*h*1, to provide a combined output signal at an uppermost coaxial output signal path 48(1). Uppermost signal path 48(1) is connected to antenna 51*a* of array 100 of FIG. 1. Uppermost signal combining board 46 (1) of FIG. 2*a* also phase-shifts the information signals as necessary, in conjunction with the phase shifts imparted by the other signal combiner boards, to cause antenna array 100 of FIG. 1 to produce a transmit beam in the desired direction. Each of the other signal combiner boards 46(2), 46(3) . . . 46(8) of FIG. 2 combines the information signals received at the eight different frequencies of the eight input signals, and makes the combined signal available on its corresponding output signal path 48(2), 48(3) . . . 48(8) (not visible in FIG. 2*a*), phase shifted as required.

FIG. 2*b* illustrates details of PD board 42 of FIG. 2*a*. For definiteness, PD board 42*h* is illustrated. In FIG. 2*b*, information signal at one of the input frequencies is applied from input port 28*h* to a cascade of three stages of 3 dB couplers, each of which divides the signal energy into two equal portions. A first stage of power division includes only 3 dB coupler 50, which divides the signal into two equal portions on signal paths 50*a* and 50*b*. The signal on path 50*a* is applied to a 3 dB coupler 52 of a second stage of couplers. Coupler 52 divides the signal received from path 50*a* into equal portions, which appear on signal paths 52*a* and 52*b*. The signal on path 52*a* is further divided by coupler 56 into two portions which appear at output ports 44*h*1 and 44*h*2. The operation of the remainder of PD board will be apparent from the above description. The result of the operation of PD board 44*h* is to produce eight identical samples of the input signal on output ports 44*h*1–44*h*8. A loss-compensating amplifier, illustrated in dash lines as 74, may be included to overcome loss of the cascade of couplers.

FIG. 2*c* is a simplified block diagram of a signal combiner board 46 of FIG. 2*a*. in FIG. 2*c*, uppermost signal combiner board 46(1) is illustrated in simplified schematic form. The other signal combiner boards of FIG. 2*a* are identical, so a description of board 46(*a*) suffices for all. In FIG. 2*c*, the information signals at the various carrier frequencies are applied to a summing circuit designated 70, and the resulting summed or combined signals are applied by way of a phase shifter 73 to the input of a power amplifier 274, which amplifies the combined signals. The amplified signals at the output of amplifier 274 are applied to output port 48(1), from which they are coupled to antenna 51*a* of FIG. 1. As illustrated FIG. 2*c*, summing circuit 70 includes a frequency multiplexing filter 72, which is well known in the art.

As described above, the prior art system receives signals by means of a reflector antenna, downconverts them, separates them according to frequency, and recombines the signals for amplification and retransmission back to Earth by means of a vertical line antenna array, which may be extended into a planar array by means of additional antennas extending horizontally fed in the same phase. This creates a directional beam in the vertical plane, which can be controlled by phase shifters in series with each antenna. Such an antenna array, while it may have gain in the orthogonal direction, cannot be independently controlled in the second plane. New satellites require higher transmitted power within their footprints. A planar or two-dimensional array may provide more power than a line array by making more ports available at which amplification can be performed, and has the additional advantage of providing controllable beamshaping in two dimensions, to allow greater concentration of the power.

SUMMARY OF THE INVENTION

According to the invention, a two-dimensional antenna array, operating at a number of different frequencies, is used to achieve directivity in two orthogonal planes, thereby providing a more constrained, or at least a more controllable, "footprint". The 2-dimensional array includes a larger number of amplifiers than a line array, thereby increasing the total power which can be combined in space, to further increase the power in the footprint. For transmission, each of the information channels at a different frequency is applied, as in the prior art, to a different power divider array, each of which may be on a separate board. Power-divided signal from each of the information signal channels is applied to an N-input, M-output power combiner arrangement or board, which combines the signals. Each NXM power combiner arrangement includes NXM nodes. Each node represents the junction or crossing of one input and one output signal transmission path. At each node, a power sample is extracted from the input signal, phase shifted, and coupled onto the output line. Each of the M output transmission lines therefore receives N phase-shifted samples of the input signal, which combine to produce the desired output signal for application to the antennas of the array. In a particular embodiment of the invention, directional couplers provide the input signal sampling and the recombining. In another embodiment, resistance taps provide the sampling.

DESCRIPTION OF THE INVENTION

Figure 1:
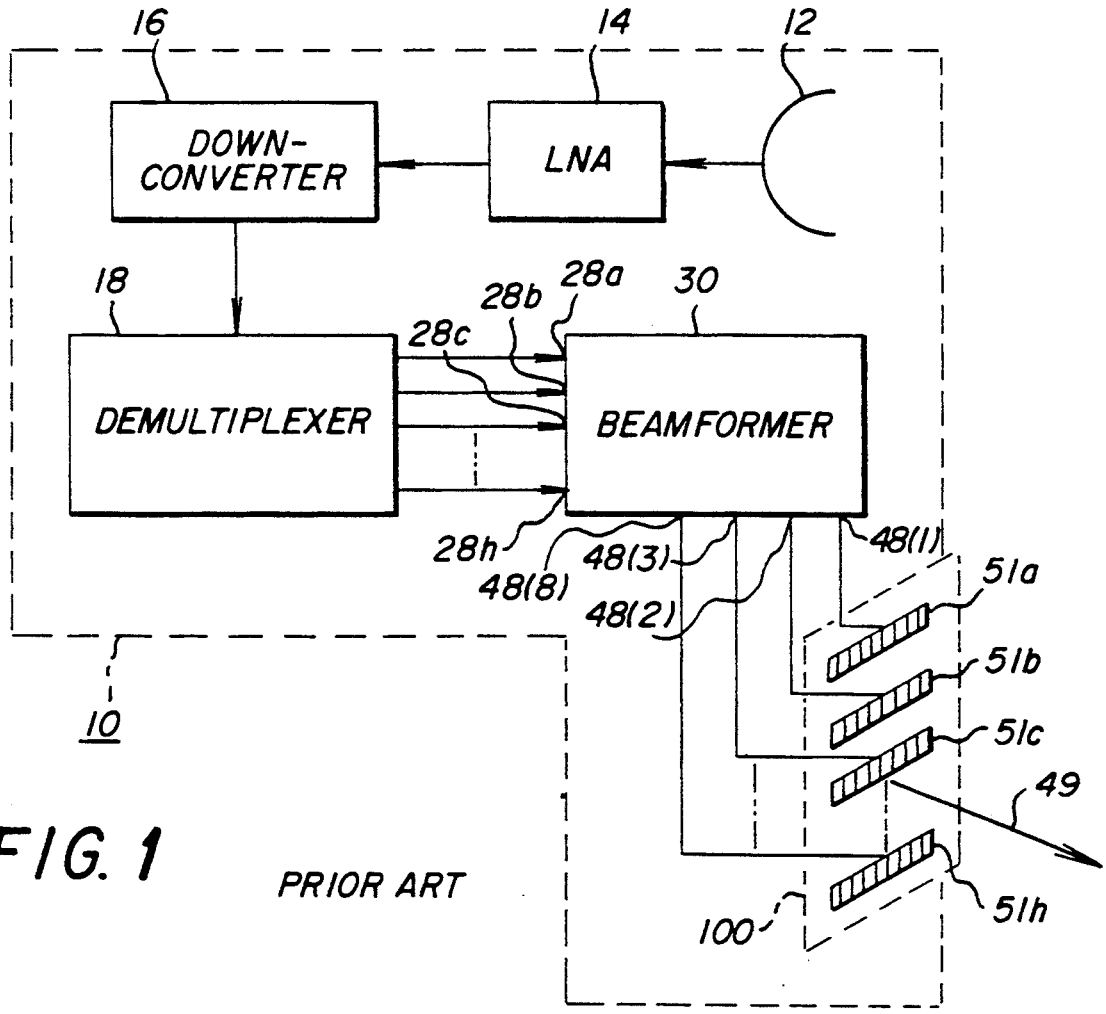
FIG. 1 PRIOR ART
FIG. 1 is a simplified block diagram of a prior-art spacecraft multichannel communications system.
Figure 2C:
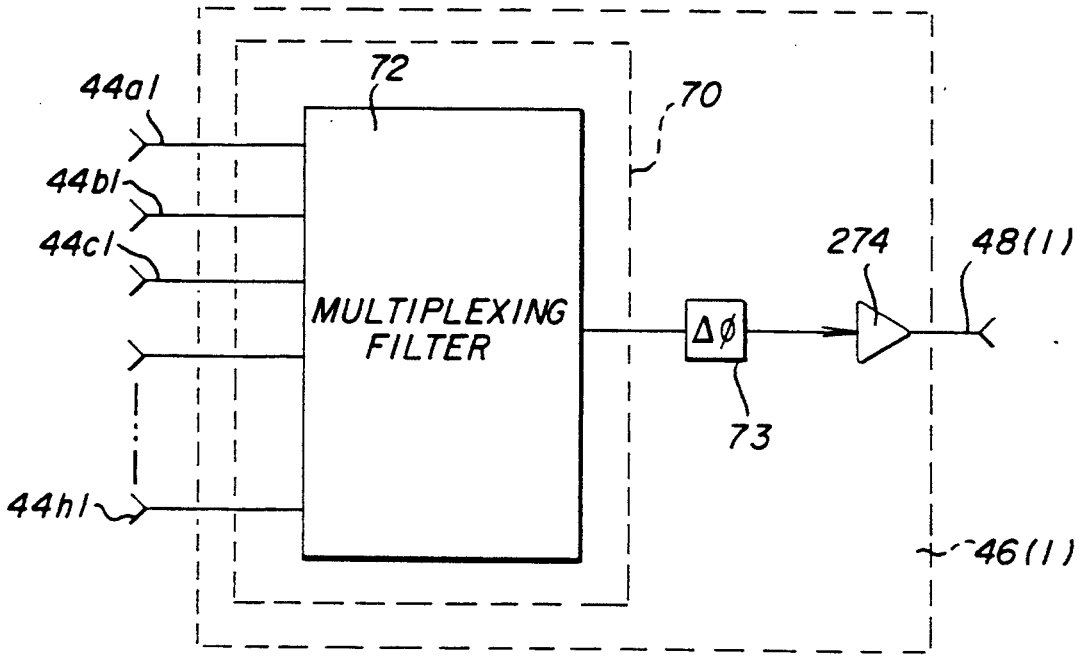
FIG. 2*c* is a simplified block diagram of a channel combiner which may be used in conjunction with the power divider of FIG. 2*b*.
Figures 2A, 2B:
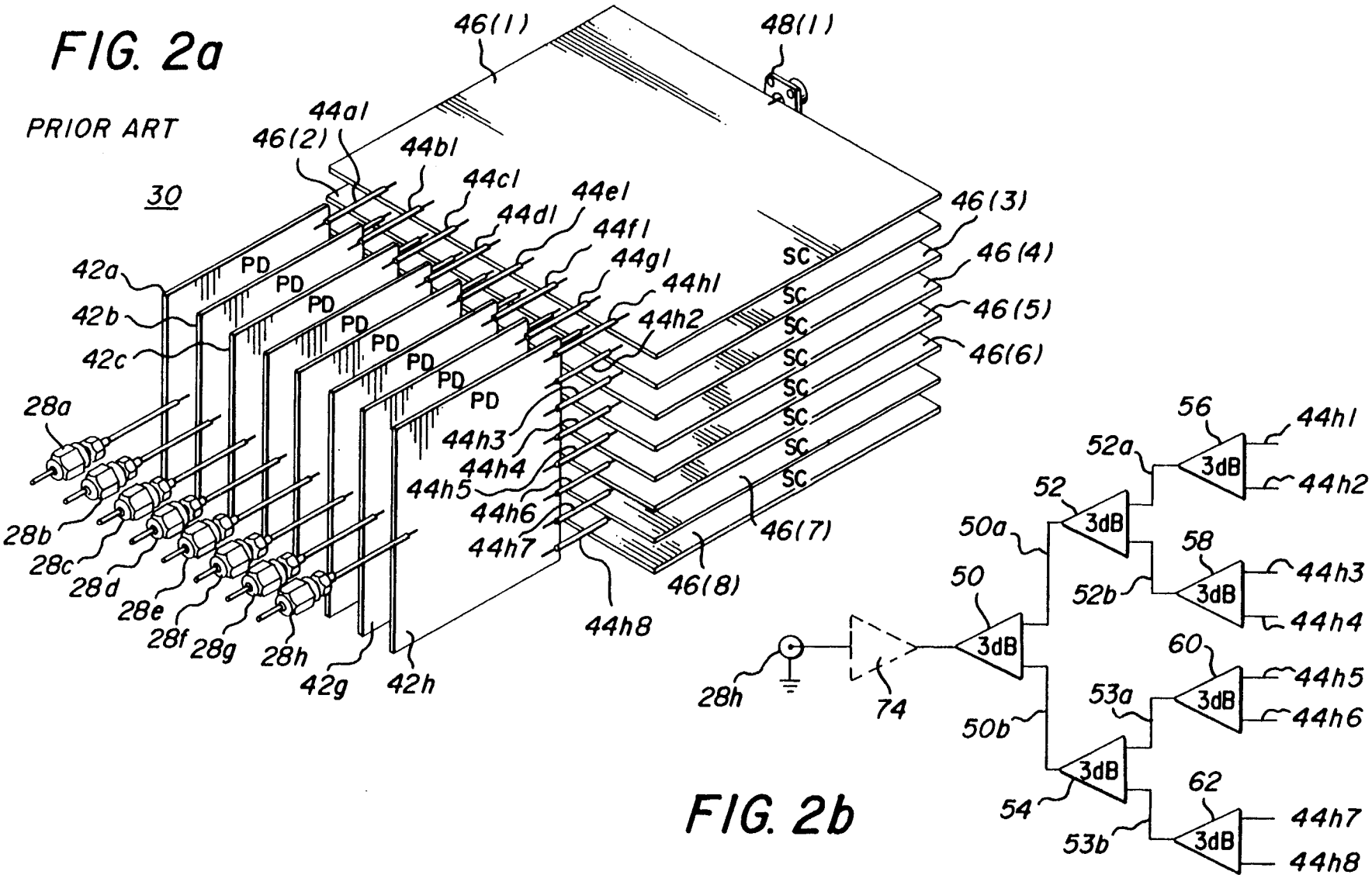
FIG. 2a PRIOR ART
FIG. 2*a* is a simplified, conceptual diagram of a prior-art beamformer which may be used in the arrangement of FIG. 1.
FIG. 2*b* is a simplified block diagram of a power divider board which may be used in the arrangement of FIG. 2*a*.
Figure 3A:
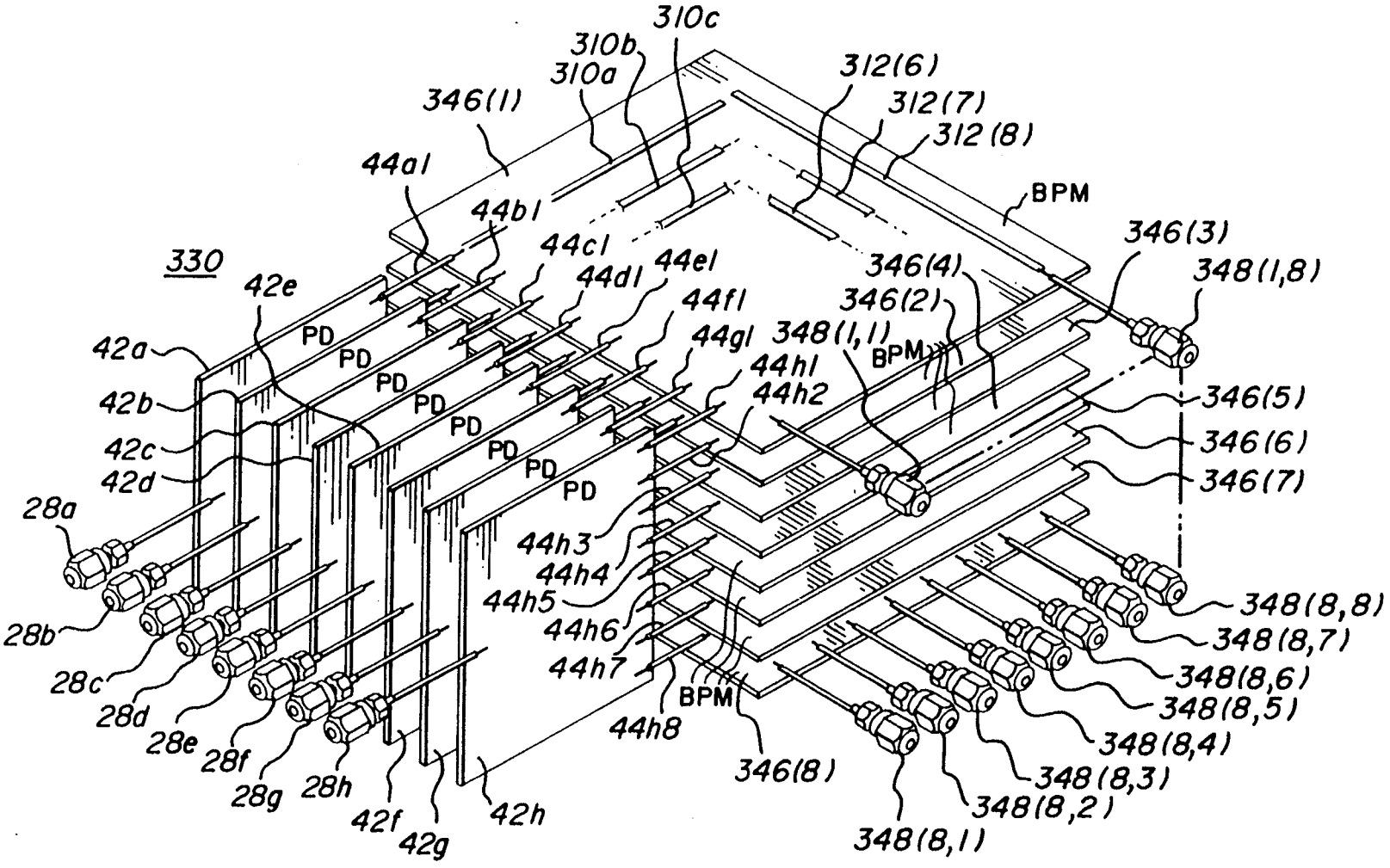
FIG. 3*a* is a simplified, conceptual diagram of a beamformer using power dividers and beam phasing networks according to the invention.

FIG. 3*a* is a simplified conceptual diagram, in perspective or isometric view, of a beamforming network 330 according to the invention. Those skilled in the art know that antennas and associated passive coupling networks are reciprocal, and operate in the same manner in both transmission and reception modes. The description is usually couched in terms of either transmission or reception, with the other mode of operation being understood therefrom. While network 330 of FIG. 3*a* could be used for either transmission or reception mode, the transmission mode is described. Elements of FIG. 3*a* corresponding to those of FIG. 2*a* are designated by like reference numerals. In FIG. 3*a*, the input ports 28*a*–28*h*, 1–8 power divider (PD) boards 42*a*–42*h* and output signal paths 44 are identical to those of FIG. 2*a*. The outputs from power dividers 42 are applied, as in FIG. 2*a*, to a plurality of beam phasing network/matrix (BPM) boards or "slices", designated 346. In the illustrated embodiment, there are eight such boards, designated, from top to bottom, 346(1) , 346(2) , 346(3) . . . and 346(8) . Unlike the arrangement of FIG. 2*a*, each board has N outputs, where N=8 in the illustrated embodiment. Each board 346 receives one information signal input at each of the different information channel frequencies, for a total of eight different input signals at eight different frequencies applied to each board. To simplify beamforming network 330 of FIG. 3*a*, the full number of eight output ports 348 are illustrated only for the lowermost BPM slice or board 346(8). More particularly, output data paths or ports 348(8,1), 348(8,2), 348(8,3) . . . 348(8,8) are illustrated as being associated with lowermost slice or board 346(8). Only the first output port 348(1,1) and last output port 348(1,8) for uppermost board 346 (1) are illustrated.

Figure 3B:
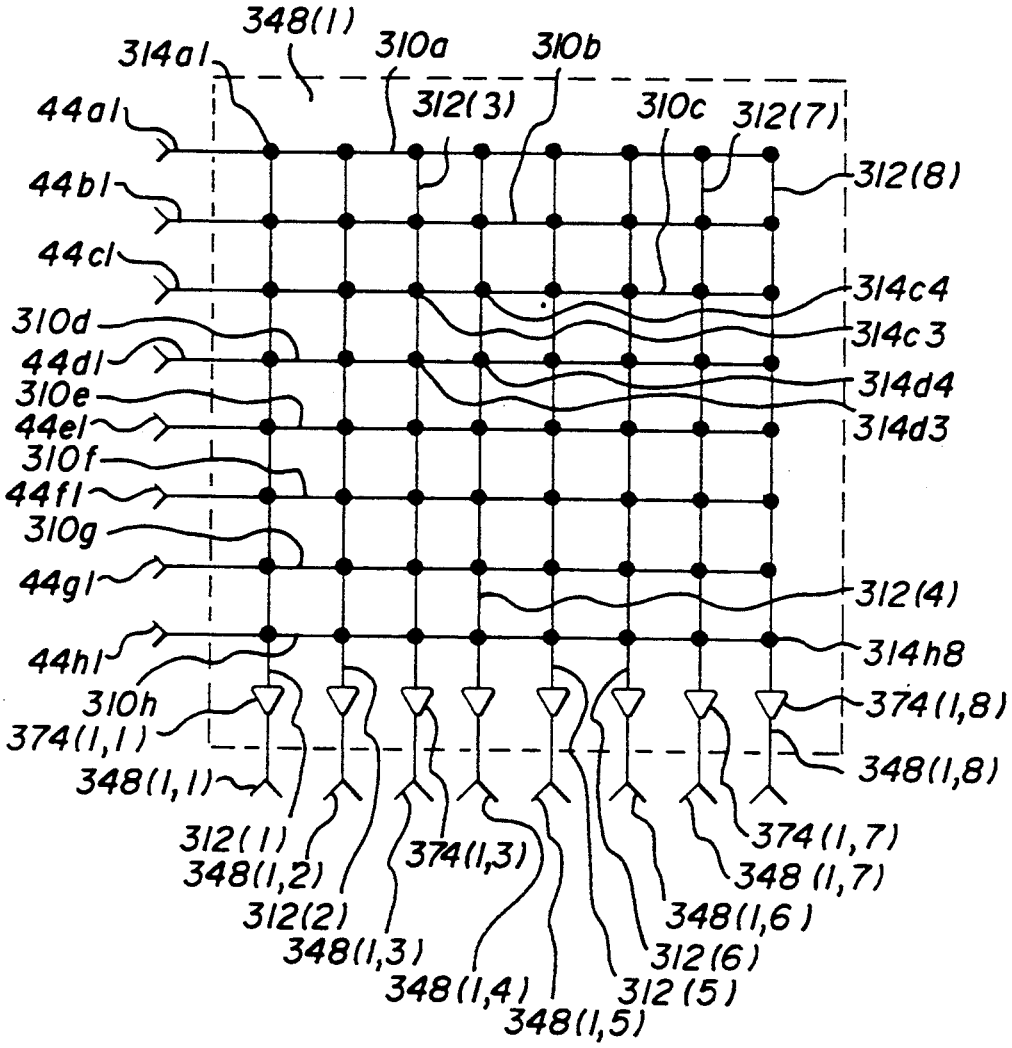
FIG. 3*b* is a simplified, conceptual plan view of one beam phasing network of the arrangement of FIG. 3*a* illustrated nodes.

Each BPM slice or board 346 of beamforming network 330 of FIG. 3*a* bears a matrix of transmission lines, as is suggested by the strip conductors of microstrip transmission lines portions designated 310*a*, 310*b* and 310*c* lying on the uppermost surface of uppermost board 346(1), and similar lines designated 312(6), 312(7) and 312(8) extending at right angles thereto. Each "input"

transmission line 310 originates at an input line 44, and each "output" transmission line 312 ends at an output port 348, as is illustrated in more detail in FIG. 3*b*. Those skilled in the art will know how to configure the ground planes associated with the microstrip transmission lines 310 and 312.

Elements of FIG. 3*b* corresponding to those of FIG. 3*a* are designated by like reference numbers. In FIG. 3*b*, all the microstrip "input" transmission lines, represented by lines 310, extend from left to right across board 348(1) parallel to each other, and may be seen to originate from a corresponding connecting signal path 44. More specifically, transmission line 310*a* extends to the right from signal path 44*a*1 near the top of board 348(1), transmission line 310*b* extends to the right from signal path 44*b*1 adjacent to and parallel with line 310*a*, transmission line 310*c* extends to the right from signal path 44*c*1, . . . and transmission line 310*h* extends to the right from signal path 44*h*1 across the bottom of board 348(1). Each "output" transmission line 312 extends downward across the board, parallel to other transmission lines 312, through an amplifier 374, each terminating in an output port 348. More specifically, output transmission line 312(1) extends downward on the left side of board 348(1), through an amplifier 374(1,1), and ends at output port 348(1,1); transmission line 312(2) extends downward adjacent to and parallel with line 348(1), through an amplifier 374(1,2), and ends at output port 348(1,2); transmission line 312(3) extends downward adjacent and parallel to line 312(2), through an amplifier 374(1,3), and ends at output port 348(1,3), transmission line 312(4) extends downward adjacent to, and parallel with, line 312(3), through an amplifier 374(1,4), and ends at output port 348(1,4); . . . and transmission line 312(8) extends downward at the right of board 348(1), parallel to the other transmission lines 312, through an amplifier 374 (1,8), and ends at output port 348(1,8). Transmission lines 310 and 312 form a grid which intersect at nodes, illustrated by dots designated 314. For example, the intersection of transmission line 310*a* with output transmission line 312 (1) is at a node, designated 314*a*1, at the upper left of FIG. 3*b*. Similarly, the intersection of lowermost input transmission line 310*h* and right-most output transmission line 312(8) is at a node at lower right of board 348 (1), designated 314*h*8. While in the simplified representation of FIGS. 3*a* and 3*b*, transmission lines 310 and 312 appear to connect at the nodes, they do not actually contact, and are interconnected as described in detail below.

Figure 3C:
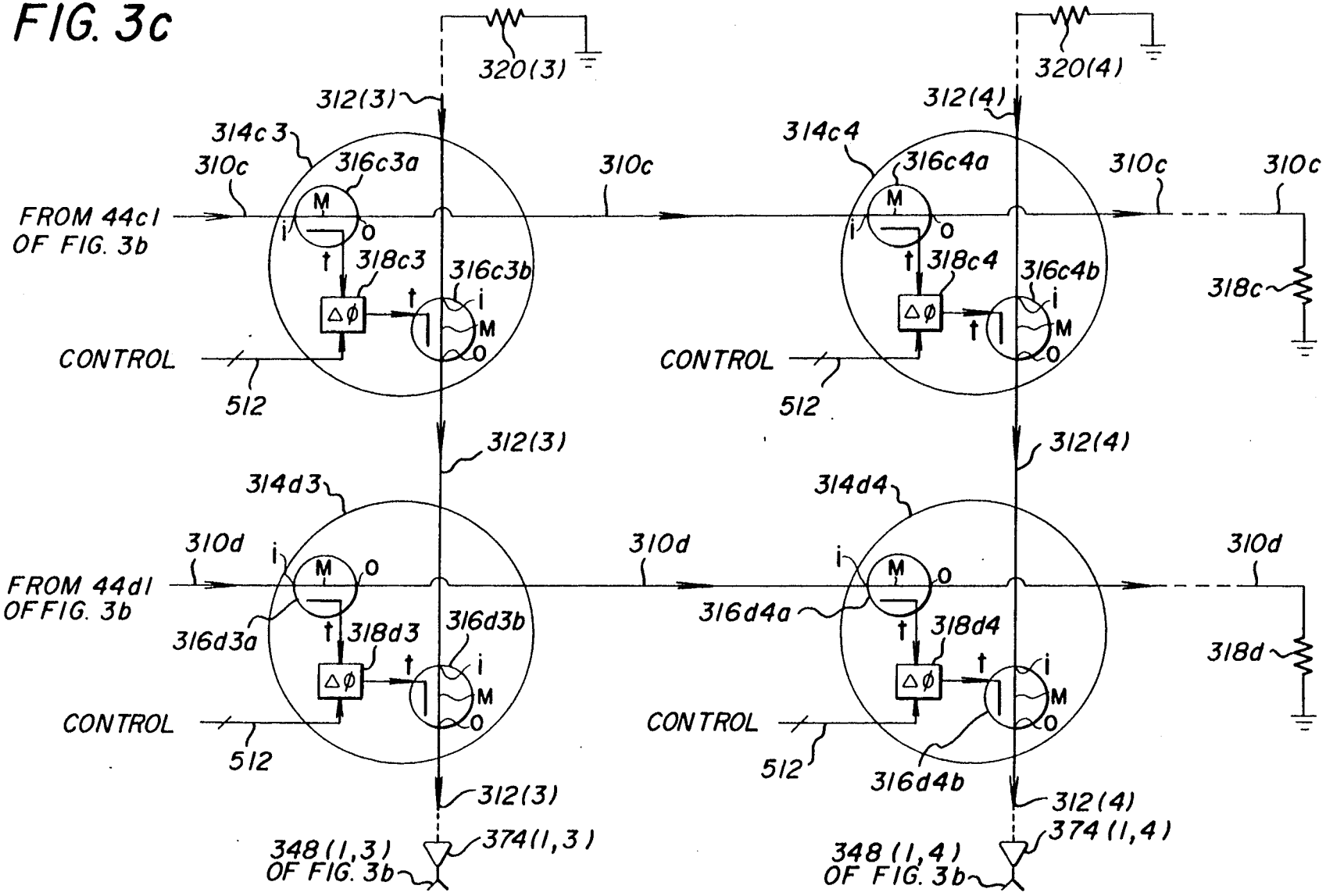
FIG. 3*c* is a block diagram illustrating directional couplers and other details of the structure of the nodes of FIG. 3*b*.

FIG. 3*c* illustrates details of the intersections of transmission lines 310*c*, 310*d* with transmission lines 312(3) and 312(4) of FIG. 3*b*, which intersections correspond to nodes 314*c*3, 314*c*4, 314*d*3, and 314*d*4. Elements of FIG. 3*c* corresponding to those of FIG. 3*b* are designated by like reference numerals. In FIG. 3*c*, each node is designated by the principal designation 314, with a two-part suffix identifying, first, the letter designation of the left-to-right transmission line 310 with which it is associated, and, second, the numeral designation of the top-to-bottom transmission line with which it is associated. Thus, node 314*c*3 is at the "junction" of left-to-right transmission lines 310*c* and top-to-bottom transmission line 312(3), node 314*c*4 is at the intersection of transmission lines 310*c* and 312(4), and nodes 314*d*3 and 314*d*4 are at the intersections of transmission line 310*d* with lines 312(3) and 312(4), respectively. The interior of each node is structurally identical to the interior of the other nodes, so only node 314*d*4, at lower right of FIG. 3*c*, is described in detail, with the operation of the other nodes being similar.

In FIG. 3*c*, node 314*d*4 includes a first signal power tap in the form of a directional coupler, designated by the suffix "a" in each node, whereby the first directional coupler in node 314*d*4 is designated 316*d*4*a*. Directional coupler 316*d*4*a* has a main (M) through transmission path including an input (i) port and an output (o) port . Signal arriving at node 314*d*4 over input transmission line 310*d* from the previous node (in this case, from node 314*d*3) enters input port i of directional coupler 316*d*4*a*, traverses its main through path M, and exits from its output port o, while coupling a portion of the input energy to a tap port t. If the amount of coupled or tapped power is small, the through-line signal attenuation will be small. For example, if directional coupler 316*d*4*a* has a coupling factor of 20 dB, one-tenth of the power applied to its input port i will be coupled to tap port t, and the remaining nine-tenths of the power, corresponding to a through loss of about one-half dB, passes through to its output port o, and thence over the continuation of transmission line 310*d* on to the next node, which would be node 314*d*5 (not illustrated). The signal power sample tapped from transmission line 310*d* by directional coupler 316*d*4*a*, and coupled to its port t, is applied to a controlled phase shifter ($\Delta\phi$) designated as 318, which in the case of node 314*d*4, corresponds to phase shifter 318*d*4. Phase shifter 318*d*4 shifts the phase by a predetermined amount, and couples the phase shifted signal sample to the tap port t of a second directional coupler, designated by the suffix b, which in the case of node 314*d*4 corresponds to directional coupler 316*d*4*b*. Directional coupler 316*d*4*b* couples the phase-shifted signal sample applied to its t port in a directional manner to its main transmission path, to exit from its output port o. Thus, the overall function of node 314*d*4 is to tap a signal sample from input transmission line 310*d*, phase-shift the sample, and to apply the phase-shifted sample to output transmission line 312(4).

Each of the nodes of 314 of FIG. 3*b*, and particularly nodes 314*c*3, 314*c*4, 314*d*3, and 314*d*4 of FIG. 3*c*, performs the above-described sampling, phase-shifting and injecting the phase-shifted sample. As mentioned, the signal coupled along a transmission line 310 decreases in amplitude as it progresses from left to right through the matrix of nodes. Thus, the signal coupled to node 314*c*3 on transmission line 310*c* is reduced in amplitude by an amount including a dissipative loss and a coupling factor (tap) loss. The dissipative loss remains roughly constant in dB from node to node, but the coupling factor loss depends upon the coupling factor. Similarly, the signal samples coupled onto transmission lines 312 experience a dissipative loss at each directional coupler through which they pass.

Input transmission lines 310 of FIG. 3*c* are terminated in a characteristic impedance, illustrated as a resistor 318 in FIG. 3*c*, after the last node, to prevent signal reflection which could perturb the operation. Thus, a resistor 318*c* of FIG. 3*c* terminates transmission line 310*c* at a location to the right of the right-most node, which would be node 314*c*8, and a resistor 318*d* terminate transmission line 310*d*. For similar reasons, the "source" ends of top-to-bottom output transmission lines 312 are terminated in characteristic impedances, illustrated as resistors 320 in FIG. 3*c*. Signals on each output transmission line 312 are coupled through an amplifier 374 before application to the corresponding output port 348. For example, signals coupled onto output transmission line 312(3) of FIG. 3*c* by nodes 314*c*3 and 314*d*3 and by other nodes (not illustrated) pass through an amplifier 374(1,3) before application to output port 348 (1,3). Similarly, signals coupled onto output transmission line 312(4) of FIG. 3*c* by nodes 314*c*4 and 314*d*4 and by other nodes (not illustrated) pass through amplifier 374(1,4) before application to output port 348(1,4).

Figure 4:
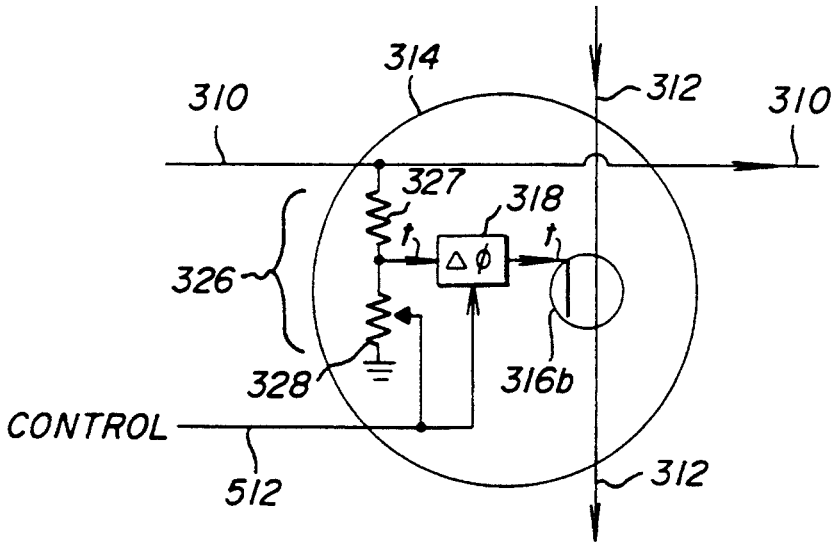
FIG. 4 illustrates, in schematic form, an alternative arrangement at a node of the arrangement of FIG. 3*b*, using a resistive tap instead of a directional coupler.

When there are many nodes, the amount of signal tapped from the "input" transmission lines 310 of FIG. 3*c* may result in a coupling loss which is less than the insertion or through loss of the directional coupler. In this case, or if greater bandwidth or lower cost is desired, a resistive tap can be used. FIG. 4 illustrates a representative node of FIG. 3*c*, modified to use a resistive tap. In FIG. 4, a generic node 314 is illustrated at the intersection of an input transmission line 310 and an output transmission line 312. A resistive (R) voltage divider 326 includes a pair of resistors 327 and 328 connected in series across transmission line 310, with a tap t at their junction. The signal sample appearing at tap t of resistive voltage divider 326 is coupled through phase shifter 318 to tap t of output directional coupler 316*b*, as in the nodes of FIG. 3*c*. If desired, resistive isolation can also be substituted for directional coupler 316*b*. Inductive (L), LR, capacitive (C) or CR taps may also be used.

As illustrated in FIGS. 3*c* and 4, each phase shifter is coupled to a multibit data path 512 designated "control". The phase shifters may be known controllable phase shifters, which can provide a phase shift which depends upon the commands applied over the control bus, and may be different for each phase shifter. This allows the beam of the antenna to be reconfigured or steered, and/or allows compensation for effects on phase caused by aging or damage. As also illustrated in FIG. 4, the control bus is coupled to resistor 328, which may be controllable, for the purpose of controlling the amplitude of the tapped signal substantially independently of its phase, to thereby allow each node to control both the phase and amplitude of the signal coupled to the output transmission line. Amplitude control can also be applied, if desired, to directional couplers, as described, for example, in allowed U.S. patent application No. 07/817,068, filed Jan. 6, 1992 in the name of Meise.

Figure 5:
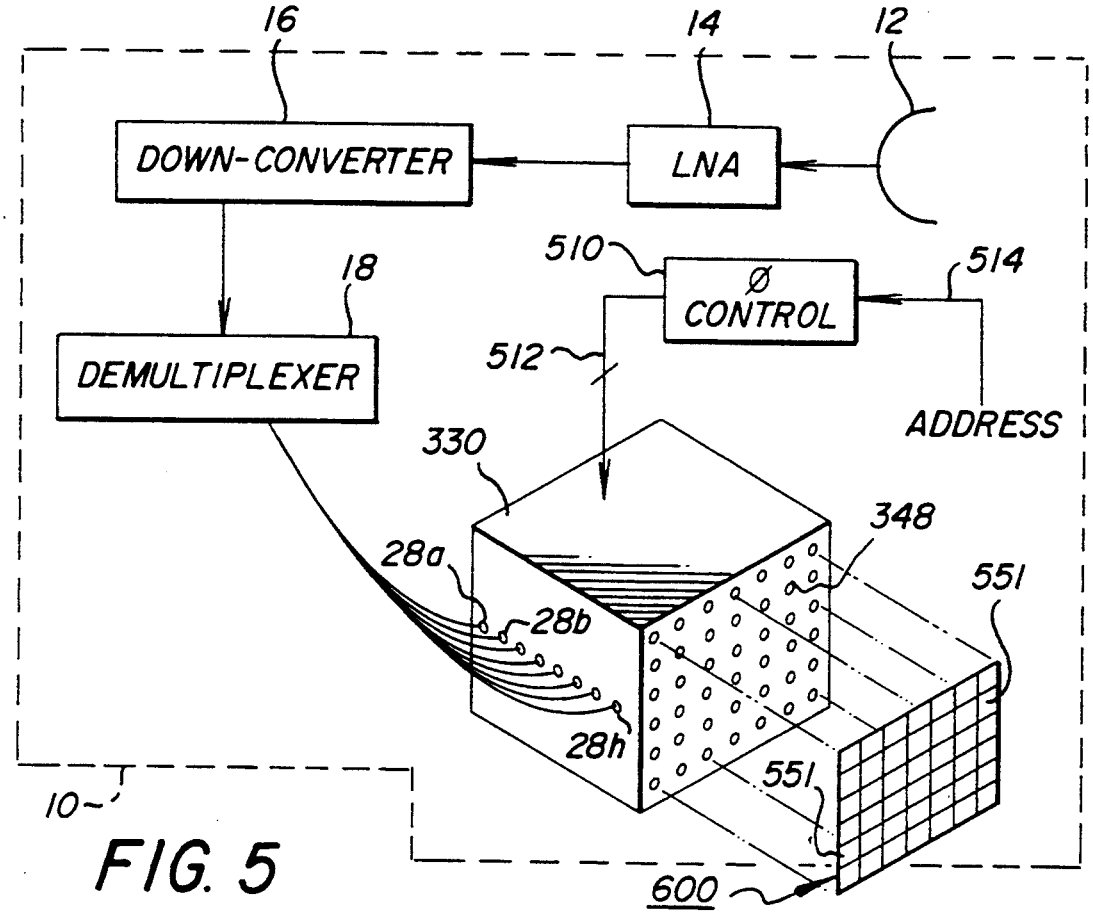
FIG. 5 is a simplified block diagram of a spacecraft with multichannel communications system according to the invention.

FIG. 5 is a simplified block diagram of a spacecraft incorporating the invention. Elements of FIG. 5 corresponding to FIGS. 1, 3*a*, 3*b* or 3*c* are designated by like reference numerals. In FIG. 5, the signals received by reflector antenna 12 of spacecraft 10 are applied to a LNA 14, a down-converter 16, and a demultiplexer 18, as in FIG. 1. The channelized or demultiplexed signals are applied to input ports 28*a*–28*h* of beamformer 330 of FIG. 3*a*. The output ports 348 of beamformer 330 of FIG. 5 are individually coupled to the arrayed antenna elements 551 of a two-dimensional antenna array 600.

A phase ($\phi$) control block 510 of FIG. 5 is illustrated as the origin of bus 512, which is coupled to the nodes 314 of FIGS. 3*c* and/or 3*d*. Phase control block 510 is essentially a ROM memory including a plurality of pages, each page of which is preprogrammed with phase shifter control data for simultaneously controlling each of the phase shifters 318 of all the nodes 314 of the system so as to form one (or more) beam(s) pointed in a particular direction(s). Each phase shifter 318 of a node 314 of FIG. 3*c* may require, for example, four control bits; in a single $8\times8$ beamforming board 346, there are 64 nodes, and in the illustrated eight-board arrangement there are a total of 512 nodes Control of the phase shifters for a single beam direction therefore requires 4 bits$\times$512 nodes/bit$=$2048 bits. The ROM included in phase control block 510 of FIG. 5 therefore requires 2K bits for phase control for each beam direction, and additional bits if amplitude control is desired, as for example for aperture tapering for low sidelobes. Beam control is established by applying page address selection signals over path 514 to the ROM of phase control block 510.

Since each element 551 of array 600 of FIG. 5 is individually controllable in amplitude and phase relative to the adjacent antenna elements, the combination of beamformer 330 and two-dimensional array 600 can produce multiple beams directed toward various reception sites, to thereby increase the effective radiation intensity in the preferred directions. Also, since each antenna element can be driven by a separate amplifier, such as an amplifier 374 of FIG. 3*c*, more total power may be transmitted, or for the same total transmitted power, lower-power amplifiers may be used; this latter may be advantageous where many highly reliable solid-state amplifiers can replace a lesser number of high-power tube type amplifiers, which may be less reliable. In addition, each frequency component of the signal applied to array antenna 100 can be independently controlled in phase, so separate and independent beams can be generated for each separate frequency component, if desired.

Other embodiments of the invention will be apparent to those skilled in the art. For example, while summing circuit 70 of FIG. 2*c* is illustrated as being a frequency multiplexing filter, it could as well be a cascade of 3 dB hybrids, similar to that of FIG. 2*b*, but operated in reverse. While eight signal frequencies have been described, more or fewer frequencies may be used, and the array antenna may include more or fewer elements. Power dividers other than 3 dB hybrid splitters or resistive dividers may be used, as for example capacitive dividers. Instead of, or in addition to placing amplifiers 374 at the output end of each output transmission line 312, an amplifier may be associated with each phase shifter ($\Delta\phi$) 318 of the arrangement of FIG. 3*c*. The elemental antennas of the array 600 of FIG. 5 may be horns, dipoles, helices, flat spirals, log periodic dipole arrays, or other linear, dual-linear, circular or elliptically polarized types. Transmission lines may be an intermixture of coaxial, conductive or dielectric waveguide, microstrip, stripline, or other types suited to the frequency and power handling of the signals. The demultiplexed signals applied to beamformer 30 may be derived from any source, either aboard the spacecraft, or converted from received signals. If the through losses of the nodes 314 of FIG. 3*c* are higher than desired, an amplifier may be associated with the input transmission line 310 or the output transmission line 312 of each node, or both.

What is claimed is:

1. A multichannel array antenna, comprising:

a plurality M of information signal sources, each of said sources being at a different operating frequency within a frequency band;

a plurality M of N-way power dividers, each of said N-way power dividers including an input port and N output ports, for dividing signal power applied to said input port into N portions, each of which N portions appears at a different one of said output ports of said N-way power divider, each of said N-way power dividers having its input port coupled to a different one of said signal sources, for generating power-divided channelized signals:

a plurality N of N×P beam phasing matrices, each of said beam phasing matrices including N input ports and P output ports, and also including a node interconnecting each of said input ports with each of said output ports, whereby each of said input ports is coupled by one of said nodes to each of P of said output ports, each of said N input ports of each of said beam phasing matrices being coupled to an output port of a different one of said power dividers, each of said nodes comprising first and second couplers and a phase shifter, each of said first couplers being coupled to an associated one of said input ports for generating a sample of said power-divided channelized signals, said phase shifter of each node being coupled to said first coupler of each node for controllably phase shifting said sample for generating a phase-shifted signal sample, and said second coupler of each node being coupled to said phase shifter of said node and to one of said output ports, for coupling at least a portion of said phase-shifted signal sample to said one of said output ports; and a plurality N×P of antenna elements, each of said antenna elements being coupled to a different one of said output ports of said beam phasing matrices, for radiating in response to that one of said phase-shifted signal sample from said one of said output ports of said beam phasing matrices.

2. An antenna according to claim 1, wherein said first and second couplers are directional couplers.

3. An antenna according to claim 1, further comprising signal amplification means associated with each one of said power dividers, for tending to compensate for signal power reduction resulting from the power division of said power dividers.

4. An antenna according to claim 3, wherein said signal amplification means comprises a plurality M of signal amplifiers, each of said signal amplifiers including an input port and an output port for amplifying signal applied to said input port, each of said signal amplification means being associated with a different one of said signal sources, and having its said input port coupled to said associated signal source, and each of said amplification means having its said output port coupled to a different one of said power dividers.

5. An antenna according to claim 1, further comprising:

phase control means coupled to each of said phase shifters of said beam phasing matrices, for storing information relating to the phase shift which each of said phase shifters must impart, and for coupling said information to said phase shifters.

6. An antenna according to claim 1 further comprising:

amplitude control means coupled to an associated one of said phase shifting means at each of said nodes, for controllably setting the amplitude of said phase-shifted signal sample.

7. An antenna according to claim 6, further comprising:

phase and amplitude control means coupled to each of said phase shifters and amplitude control means of aid beam phasing matrices, for storing information relating to the phase shift and amplitude which each phase shifter and associated amplitude control means must impart.

8. An antenna according to claim 1, further comprising power amplification means coupled to each of said output ports of said beam phasing matrices and to said antenna elements, for amplifying said phase shifted signal samples.

9. An antenna according to claim 1, where M=N.

10. A method for transmitting a plurality M channelized signals at different frequencies by means of an antenna array, comprising the steps of:

dividing each of said M channelized signals into a plurality N of power-divided signals, to thereby generate M sets of power-divided signals, one set at each of said different frequencies;

applying one of said N power-divided signals from each of said M sets of power-divided signals to one of N separate beam phasing M×P matrix, whereby each of said beam phasing matrices receives a set of M power-divided input signals, each at a different one of said frequencies;

within each of said beam phasing matrices, generating P power-divided signal portion sets from each of said M power-divided input signals applied thereto;

within each of said beam phasing matrices, phase-shifting each of said power-divided signal portions to produce M sets, each of P phase-shifted signal portions;

within each of said beam phasing matrices, summing together sets of said phase-shifted signal portions, to produce P output signals, each of said P output signals being the sum of one of said phase-shifted signal portions from each of said M sets, to produce an array of beam phasing matrix output signals; and coupling each of said beam phasing matrix output signals to an individual antenna element of an antenna array.

11. A method according to claim 10, wherein aid step of dividing further comprises the step of signal amplification, whereby said M sets of power-divided signals are greater in amplitude than in the absence of said step of signal amplification.

12. A method according to claim 10, wherein said step of coupling includes the step of signal amplification, whereby said beam phasing matrix output signals applied to said antenna elements are amplified.

13. A spacecraft, comprising:

receiving means for receiving a plurality of uplink signals, each extending over a different frequency range within an uplink frequency band, and for processing said uplink signals to distribute said uplink signals to a like plurality of different channels, to thereby generate a plurality of information signals, each at a different operating frequency in an independent signal path of a plurality of signal paths;

a plurality M of N-way power dividers, each of said N-way power dividers including an input port and N output ports, for dividing signal power applied to said input port into N portions, each of which N portions appears at a different one of said output ports of said N-way power divider, each of said N-way power dividers having its input port coupled to a different one of said signal paths, for generating power-divided channelized signals:

a plurality N of N×P beam phasing matrices, each of said beam phasing matrices including N input ports and P output ports, and also including a node interconnecting each of said input ports with each of said output ports, whereby each of said input ports is coupled by one of said nodes to each of P of said output ports, each of said N input ports of each of said beam phasing matrices being coupled to an output port of a different one of said power dividers, each of said nodes comprising a first and second couplers, and a phase shifter, each of said first couplers being coupled to an associated one of said input ports for generating a sample of said power-divided channelized signals, said phase shifter of each node being coupled to said first coupler of each node for controllably phase shifting said sample for generating a phase-shifted signal sample, and said second coupler of each node being coupled to said phase shifter of said node and to one of said output ports, for coupling at least a portion of said phase-shifted signal sample to said one of said output ports; and a plurality $N \times P$ of antenna elements, each of said antenna elements being coupled to a different one of said output ports of said beam phasing matrices, for radiating in response to that one of said phase-shifted signal sample from said one of said output ports of said beam phasing matrices.

* * * * *